US006024605A

United States Patent [19]

Beck, Jr. et al.

[11] Patent Number: 6,024,605

[45] Date of Patent: Feb. 15, 2000

[54] ELECTRICAL CONNECTOR WITH INTERLOCKING LIVING HINGE

[75] Inventors: Hoy Smith Beck, Jr., Lexington; Dana Marpoe, Kernersville; Fred Howard Fisher, Jamestown, all of N.C.

[73] Assignee: The Whitaker Corporation, Wilmington, Del.

[21] Appl. No.: 08/993,737

[22] Filed: Dec. 19, 1997

[51] Int. Cl.[7] ..... H01R 13/40

[52] U.S. Cl. ..... 439/595; 439/596

[58] Field of Search ..... 439/596, 595

[56] References Cited

U.S. PATENT DOCUMENTS

| | | | |
|---|---|---|---|
| 4,045,112 | 8/1977 | Rodondi et al. | 339/99 R |
| 4,557,542 | 12/1985 | Coller et al. | 339/59 M |
| 4,711,508 | 12/1987 | Sueyoshi | 439/595 |
| 4,721,482 | 1/1988 | Fuduka et al. | 439/595 |
| 4,753,612 | 6/1988 | Betsui | 439/596 |
| 4,867,705 | 9/1989 | Yuasa | 439/596 |
| 5,106,326 | 4/1992 | Tsuji et al. | 439/596 |
| 5,160,283 | 11/1992 | Fry et al. | 439/752 |
| 5,518,337 | 5/1996 | Yagi et al. | 403/291 |
| 5,545,054 | 8/1996 | Benes et al. | 439/467 |
| 5,820,410 | 10/1998 | Genta et al. | 439/595 |
| 5,860,834 | 1/1999 | Sugiyama | 439/595 |

FOREIGN PATENT DOCUMENTS 190673 of 0000 Japan .

OTHER PUBLICATIONS

AMP Customer Drawing C–776195 (May 23, 1996).

*Primary Examiner*—Neil Abrams
*Assistant Examiner*—Hae Moon Hyeon

[57] ABSTRACT

An electrical connector (2) includes a living hinge (40) joining a cover (36) to a main connector housing (10). The cover (36) functions as a terminal position assurance or locking member. When properly positioned, the cover (36) backs up terminal latches (18) securing terminals (70) in housing cavities (14). The living hinge (40) is located on the rear edge of the cover (36) which pivots forward to enclose a housing opening (32) on the mating half of the electrical connector (2). Longitudinally extending projections (52) on the cover extend beside the living hinge (40). Longitudinally extending projections (26) extend from a housing wall (22) beside the living hinge and toward the projections (52). The projections (26, 56) are rotated into overlapping relationship when the cover is closed and interlock the rear of the cover (36) in the event of damage to the living hinge (40). Opposing shoulders (30) and (60) on the housing (10) and cover (36) prevent longitudinal movement of the cover (36) relative to the housing (10) and a cover latch (66) is located on the front of the cover (36). The assembly can be molded with straight pull mold tooling.

25 Claims, 4 Drawing Sheets

ELECTRICAL CONNECTOR WITH INTERLOCKING LIVING HINGE

BACKGROUND OF THE INVENTION

1. Field of the Invention

This invention involves an interlocking living hinge between a cover and a integral housing. More particularly, this invention is employed in an electrical connector having an hinged locking and terminal position assurance member connected to a connector housing by an interlocking living hinge.

2. Description of the Prior Art

Living hinges are commonly used on plastic components, such as electrical connector housings, to join two components of a thermoplastic insulating housing. The most common application for electrical connectors is to use a living hinge to join a cover to a main housing. The living hinge connects the two main components, such as the cover and the base of a connector housing, so that the entire assembly is an integral component. The living hinge is flexible so that the cover can be rotated into position closing an opening in the housing or base. Typically the thickness of the living hinge is less than adjoining components, and when molded from a appropriate material, the hinge is sufficiently flexible so that it can be bent without being destroyed or severed. However, living hinges are susceptible to damage if repeatedly flexed, and living hinges used on electrical connectors are typically not intended to be flexed for many cycles. There is also the problem of deterioration of the plastic material with time which can make the living hinge more brittle, and therefore more subject to damage, with time. Although some plastics are more suitable for use in living hinges, some of these plastics possess other characteristics that make them less suitable for use in a rigid insulating housing that must protect terminals and contact interfaces in the operational environment of the electrical connector.

One common use of living hinges for electrical connectors is to use the living hinge to connect a cover enclosing a wire insertion section of an electrical housing. This approach is commonly used with insulation displacement connectors in which the cover is applied after the wires are inserted in wire receiving slots. In such applications additional latches are commonly employed to secure the cover to the housing and the living hinge serve little if any purpose after the cover has been attached to the housing.

Rotating covers has also been employed as locking members in electrical connectors. These covers contain latching features that engage a terminal after it has been inserted into a terminal cavity in the housing. The living hinge holds the cover in a retracted position while the terminal or terminals are inserted into the housing. The cover is then rotated about the living hinge to bring the locking or latching surface into engagement with the terminal to prevent extraction of the terminal. In these applications the cover can include latching features that limit the function of the living hinge to the original mating of the cover with the housing.

In some electrical connector applications, such as automotive applications, it is especially important to insure that all terminals are properly positioned in an electrical connector housing on a mass production basis. Therefore terminal position assurance or terminal position assistance members have been employed. These members insure that the connector cannot be properly assembled unless all terminals are properly positioned in the connector housing. Furthermore it is important that two connectors cannot be mated unless terminals are properly positioned in the connector housing. One approach to providing terminal position assurance is to employ a sliding member that backs up or locks a separate terminal latch into place after the terminal has been properly inserted. Typically this separate terminal latch is a plastic beam that is integral with the housing and protrudes into the housing cavities into which the terminals are inserted from the rear. The terminal latch deflects out of the way to permit insertion of the terminal. When the terminal is completely inserted, the terminal latch then returns to its normal position. If the terminal latch is in its normal position, the terminal position assurance member can slide in behind the terminal latch. If the terminal has not been completely inserted, and the terminal latch remains at least partially deflected, the terminal position assurance member cannot be fully inserted. If the terminal position assurance member is located on the mating portion of the electrical connector, the connector cannot be mated unless the terminal position assurance member is properly positioned.

If a pivoting cover is to be reliably used as a terminal position assurance member, it is important that the cover be properly secured in all directions. If a living hinge it used, the living hinge may not provide a sufficiently reliable means of securing the terminal position assurance member along the portion of the cover to which the hinge is attached. Since space is always a significant problem, any means of assuring that the cover is properly retained in the event of damage to the living hinge must be small and relatively unobtrusive.

SUMMARY OF THE INVENTION

An electrical connector in accordance with this invention includes a living hinge joining a cover to a main housing. The living hinge is integrally molded to a housing wall and to the cover. Rotation of the cover closes an opening in the housing wall of the connector housing. The cover and the housing wall each include interlocking projections located beside the living hinge. An interlocking projection on the cover rotates beneath an interlocking projection on the housing wall when the cover is rotated to close the opening. The interlocking projections prevent dislodgment of the cover from the housing wall adjacent to the living hinge in the event of damage to the living hinge.

The electrical connector includes at least one terminal and a molded housing with cavities for each terminal. Each terminal is secured within a corresponding cavity by a terminal latch. The cover includes a cover latch at the front of the cover to secure the front of the cover in the closed position, and the living hinge is located on the rear of the cover. The interlocking housing and cover projections are each adjacent to the living hinge. These projections extend longitudinally and overlap when the cover latch engages the housing with the cover in a closed position. The cover thus serves as a locking or terminal assurance member and the interlocking projections secure the rear of the cover to the housing in the event of damage to the living hinge.

The interlocked living hinge of this invention is therefore suitable for use as a terminal position assurance or locking member. The interlocking projections do not require additional space and this interlocked living hinge can be used in connectors having traditional centerline spacings. The interlocked projections also do not require significant clearance to be rotated past each other into their final interlocking positions. Furthermore the living hinge and the interlocking projections can be economically molded using straight pull tooling.

DETAILED DESCRIPTION OF THE PREFERRED EMBODIMENT

Figure 1:
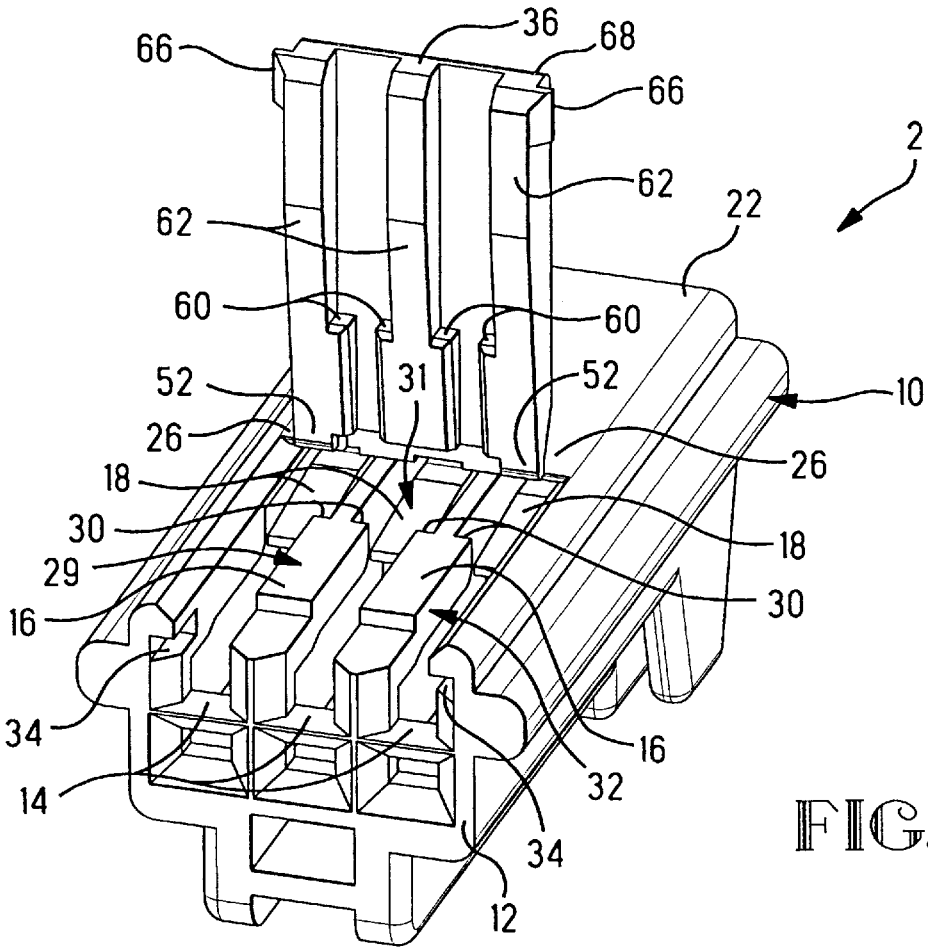
FIG. 1 is a perspective view of the front or mating side of an electrical connector housing with a cover joined to the housing by a living hinge.

The electrical connector 2, as the representative embodiment of this invention, has a molded housing 10 in which three terminals 70 are located side by side. The housing 10 is preferably molded from a thermoplastic such as a non-glass-filled PBT. The main housing 10 has a cover 36 that is integrally molded and is joined to the main housing 10 by a living hinge 40.

The main molded housing or body 10 is matable with a pin header or other connector 76 and is in most respects typical of electrical connector housings employed in automotive electrical connectors. Housing 10 has a mating face 12 onto which three housing cavities 14 open. These cavities 14 are side by side and each outer cavity is separated from the inner cavity by housing partitions 16. A deflectable terminal latch 18 is located in each housing cavity 14, and these terminal latches comprise the primary means for securing and retaining individual terminals 70 in corresponding cavities 14. The deflectable terminal latches 18 are integrally molded extensions of the main housing 10 and they are typical of molded terminal latches that are formed by opposed mold tooling pins that define the housing cavity configuration in a connector housing that is fabricated by straight pull molds. The deflectable latches 18 each engage a terminal 70 after the terminal has been inserted into the housing cavity 14 from the rear of the main housing 10. As the terminals 70 are inserted, the deflectable latches 18 deflect outward into a recess 20 on the rear of each deflectable latch 18 as the mating section 72 passes the terminal latch 18. When the terminal 70 reaches the fully inserted position, the terminal latch returns to its normal position and engages a shoulder or enters a hole on the terminals to prevent withdrawal of each terminal 70 from the corresponding cavity 14 through the rear of the housing 10. A stop surface on the front of the housing 10 prevents forward movement of the terminal 70.

Housing 10 has an upper wall 22 that extends from the rear of the housing to a point intermediate the ends of a housing where the housing wall 22 is joined to a cover 36 by a molded living hinge 40. The cover 36 is configured to close a longitudinally extending housing opening 32 on the mating side of the connector housing 10. The width of the living hinge 40 is less than the width of the cover 36 and of the housing opening 32. Two housing interlocking projections 26 are located on the front of the upper housing wall 22 on each side of the living hinge 40. Both housing interlocking projections 26 extend between the edges 44, 46 of the living hinge 40 and the side walls of the housing 10 extending perpendicular to the top wall 22 from which the projections 26 extend. Each housing projection has an inwardly facing inclined surface 28 that extends from the forward edge of the projection 26 and housing wall 22 to the recess 20 behind the adjacent terminal latch 18. The living hinge 40 extends from the outer surface 24 of wall 22 to the inside of and behind the flanking projections 26.

The mating portion of the top of the housing cavities 14 are open in the housing opening 32 and the top of the partitions 16 extend upwardly toward opening 32. These partitions 16 include enlarged sections 29 in the center of the housing opening 32 which form rearwardly facing shoulders 30 at a location longitudinally spaced in front of the living hinge 40 and the housing projections 26. These shoulders 30 are at the front of enlarged sections 31 of the cavities just above the front end of the terminal latches 18, the living hinge 40, and the housing projections 26. The front end of the terminal latches 18 extend beyond the intersection of the living hinge 40 with the housing wall 22 and the projections 26.

Figure 6:
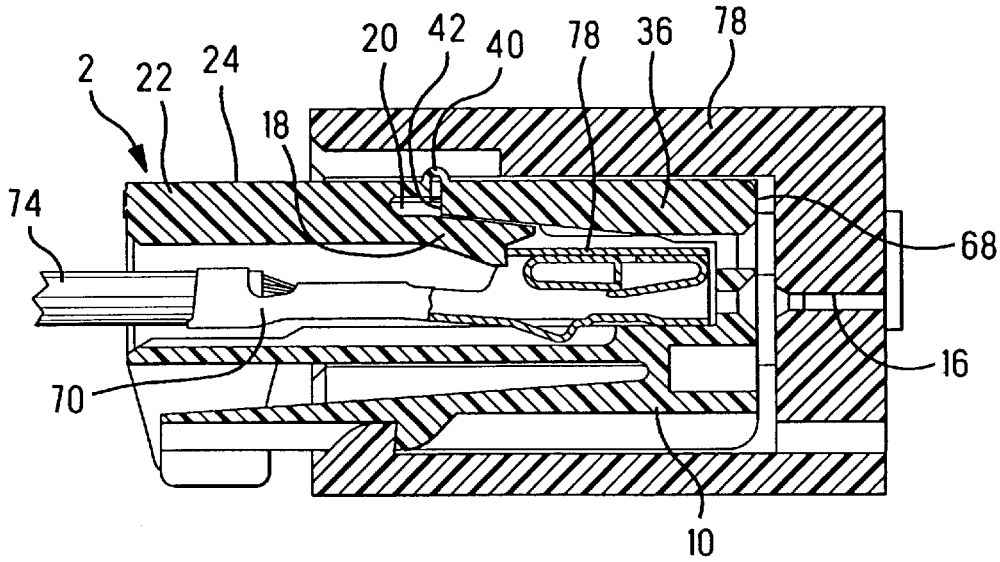
FIG. 6 is a side section view with the terminal position assurance cover in the closed position showing the interlocking projections on the cover and the upper housing wall.
Figure 2:
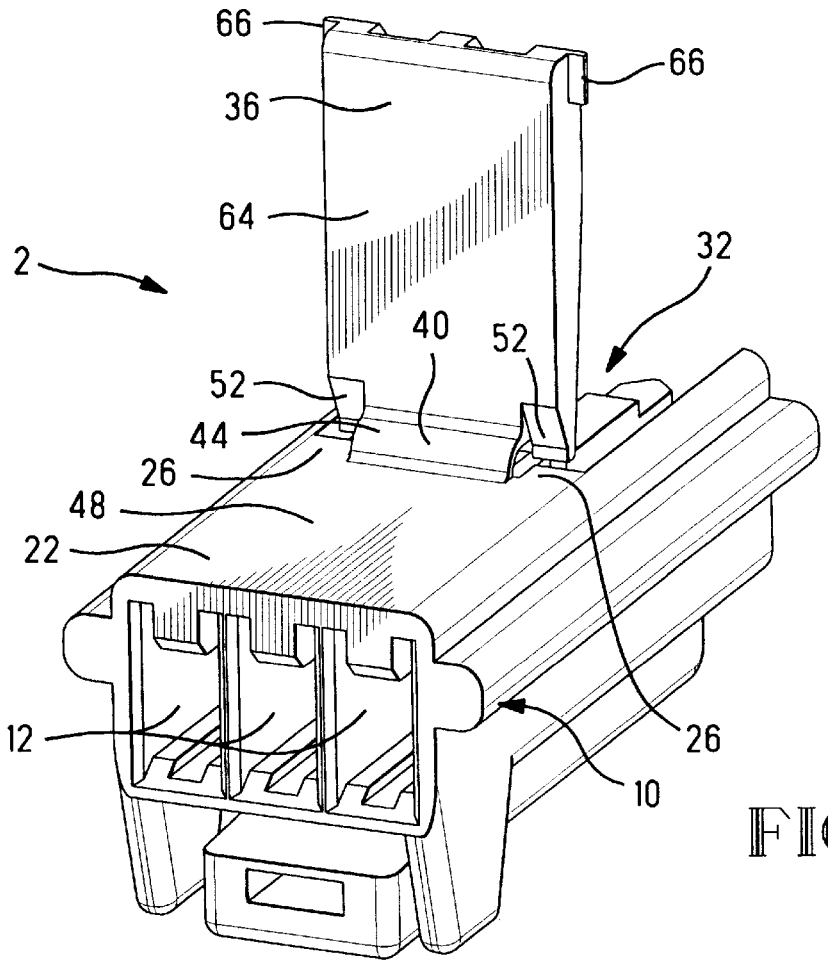
FIG. 2 is a perspective view of the rear of the electrical connector housing of FIG. 1 with the cover in an open position.
Figure 7:
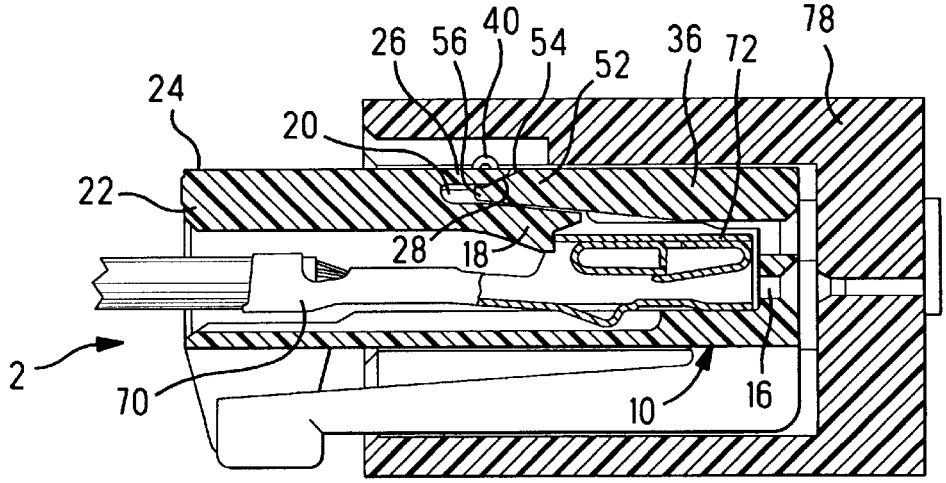
FIG. 7 is a side section view parallel to the section view of FIG. 6 showing the living hinge with the terminal position assurance cover in the closed position.
Figure 3:
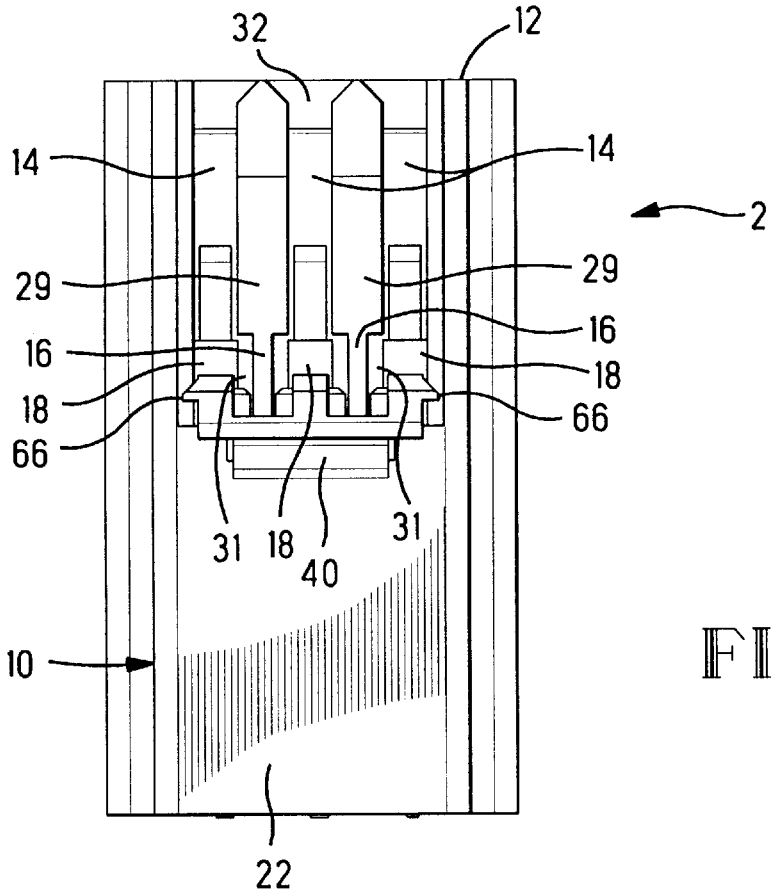
FIG. 3 is a top plan view of the connector housing shown in FIGS. 1 and 2.
Figure 4:
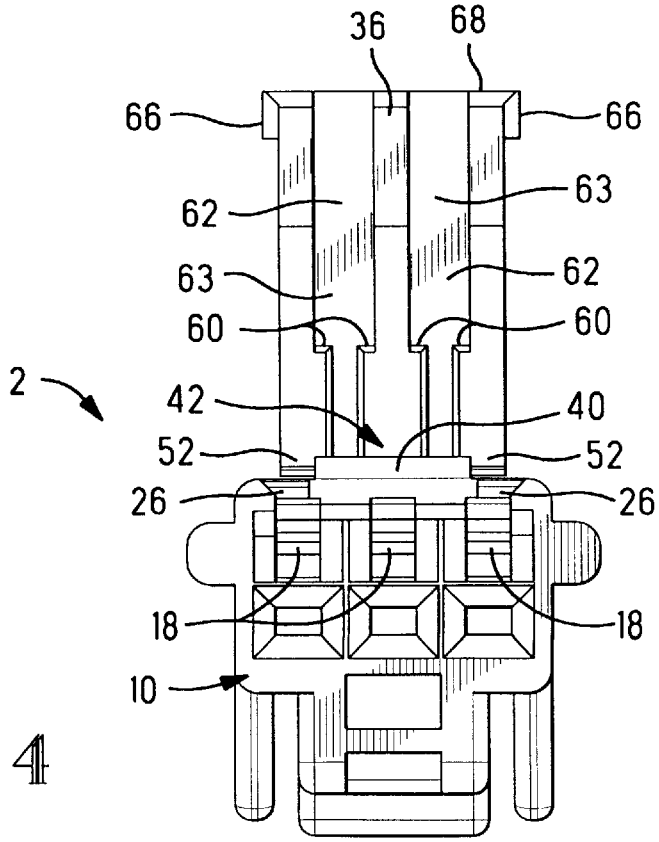
FIG. 4 is a front view of the connector housing shown in FIGS. 1 and 2 showing the cover in the open position.

The cover 36 is pivotal about the living hinge 40 from the open position shown in FIGS. 1–5 to the closed position shown in FIGS. 6 and 7. The living hinge 40 is integral with the housing 10 and the cover 36 and of course is made from the same material. Although the material used to mold the housing 10 must be sufficiently rigid to hold the terminals in place, the living hinge is thinner than other portions of the housing 10 and can therefore flex sufficiently for the cover 36 to be rotated to the closed position. In the preferred embodiment, the thickness of the living hinge 40 is approximately 0.3 mm. The living hinge has a first lateral edge 44 and an opposite second lateral edge 46, each of which is spaced inwardly from the sides of the cover 36 and housing opening 32. One housing projection 26 extends beyond the first hinge edge 44 and the other housing projection extends beyond the second hinge edge 46. The hinge upper surface 48 extends from the wall outer surface 24 and is behind the hinge lower surface 50 in the open position. The inclined surfaces 28 and 54 provide clearance for the projections 26 and 52 to rotate around each other during rotation of the cover 36 from the open to the closed position.

The cover 36 includes cover latches 66 on opposite sides of the front or longitudinal distal end 68 of the cover 38. These cover latches 66 can be snapped into outwardly facing latching grooves 34 on the front of the housing 10. These latches will thus serve to secure the front of the cover 36 to the housing 10 when the cover 36 is in the closed position. FIG. 7 shows the curved, deformed or stressed configuration of the living hinge 40 when the cover 36 is closed. In the open position, the cover 36 extends at substantially a right angle to the upper housing wall 22, and the living hinge 40 extends through an arc between the housing 10 and the cover 36. The cover 36, also fabricated from the same material, extends longitudinally from a base end 42 adjacent to the living hinge 40 to a front distal end 68. The living hinge 40 extends from the cover top surface 64.

Rearwardly extending cover interlocking projections 52 extend from the rear edge of the cover 36 on opposite sides of the living hinge 40. These cover interlocking projections 52 extend only beyond the side edges 44, 46 of the living hinge 40 and overlap housing projections 26, but do not overlap the living hinge 40. Each of the cover interlocking projections 52 has an inclined surface 54 extending from the cover top surface 64 longitudinally across the living hinge 40 when the cover 36 is in the open configuration. In other words in the open position the inclined surfaces extends from behind the hinge upper surface 48 to a position in front of the hinge lower surface 50. Each cover projection 52 also includes a ledge 56 on the rear free end of the projection 52 that extends beyond the inclined surface 54. The thickness of the ledge 56 is such that the ledge 56 can be received in the recess 20 behind the terminal latches 18 when the cover 36 is in the closed position.

The cover inner surface 58 faces forward when the cover 36 is in the open position. This inner surface includes cover ribs 62 which, in the closed position, are in line with the housing cavities 14 and forwardly facing cover shoulders 60 extending laterally from the ribs 62. The ribs form cover slots 65 into which the housing partitions 16 extend when the cover 36 is in the closed position. With the cover 36 in the closed position, the forwardly facing cover shoulders 60 are opposed to the rearwardly facing housing shoulders 30 and these opposed shoulders 30, 60 are at substantially the same elevation. Therefore the shoulders 30, 60 are blocking and would prevent forward movement of the cover 36 relative to the housing 10 when the cover 36 is in the closed position. The cover ribs 62 fit between the housing partitions 16 and into the top of the housing cavities 14 to close the top of the housing cavities 14. The enlarged sections 63 of the ribs 62, on which the shoulders 60 are formed, fit with the larger sections between housing partitions 16 at the rear of the housing opening 32 and above the portion of the terminal latches 18 extending into the housing opening 32. The enlarged sections 63 of the ribs 62 thus serve to back up the terminal latches 18 if the latches have returned to their normal position. If one of the terminal latches 18 has not returned to its normal position, because the corresponding terminal 70 has not been completely inserted, the rib sections 63 will abut the outwardly deflected terminal latch 18 and the cover 36 cannot be closed and the cover latches 66 cannot be inserted into the housing latch grooves 34.

FIGS. 6 and 7 show the cover 36 in the closed position with the connector 2 mated with the housing 78 of a mating electrical connector, such as a pin header. FIGS. 6 and 7 also show the position of the terminals 70 and of the terminal mating sections 72 which are located below the closed cover 36 with the terminal latches 18 engaging the rear edge of the terminal mating section 72. These figures show the terminals 70 in the fully inserted position As can be seen from FIGS. 6 and 7, the connector 2 could not be inserted into the mating connector housing 78 unless the cover 36 is completely closed. Since the cover 36 cannot be closed unless terminals 70 are fully inserted, the hinged cover 36 comprises a terminal position assurance member as well as a locking member.

Although the cover 36 serves as a locking member or as a terminal position assurance member, retaining the terminal latches 18 in engagement with the terminals 70 so long as the rear of the cover 36 remains in place. Normally the living hinge 40 would prevent dislodgment or disengagement of the rear of the cover 36. However, because the living hinge 40 is relatively thin, it is more subject to damage. Such damage can occur as a result of handling, but eventually it can also occur with time due to the deterioration of the plastic. Even if the living hinge 40 is damaged, ruptured or separated, the rear of the cover cannot shift away from the terminal latches 18 if the cover is still to perform its locking and terminal position assurance functions. The interlocking and overlapping projections 26 and 52 prevent upward movement of the rear of the cover 36 even if the living hinge 40 is severed. The inclined surface 28 of the housing projection 26 is above the inclined surface 34 of the cover projection 54 to keep the cover 36 from moving away from the terminal latches 18. The ledge 56 on the cover projection 52 fits within the recess 20 behind a corresponding terminal latch 18. The cover projection 52 is therefore trapped beneath the housing projection 26 so that the rear end of the cover 36 cannot move away from the terminal latch 18 even if the living hinge 40 is severed. The opposed shoulders 30 and 60 prevent longitudinal movement of the cover 36, so the overlapping relationship of the projections 26 and 52 cannot be defeated. The front cover latches 66 are secured within the housing grooves 34. Finally, the side and rear edges of the cover 36 are trapped within the housing opening 32 so the cover 36 cannot be dislodged or disengaged even if the living hinge 40 is damaged or even severed. The cover 36 can only be removed by use of a tool to dislodge the cover latches 66 at the front of the cover 36.

Figure 5:
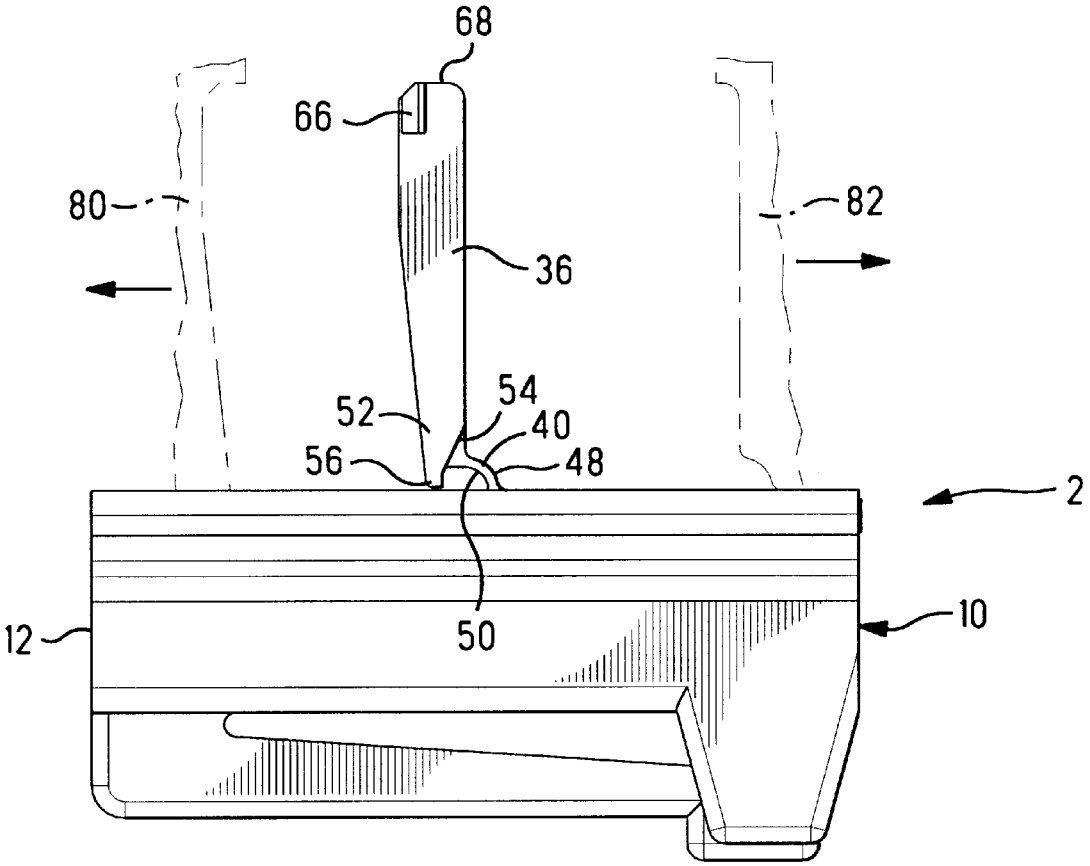
FIG. 5 is a side view of the connector housing shown in FIGS. 1 and 2 showing the cover in the open position and the cover interlocking projection on one side of the living hinge.
Figure 8:
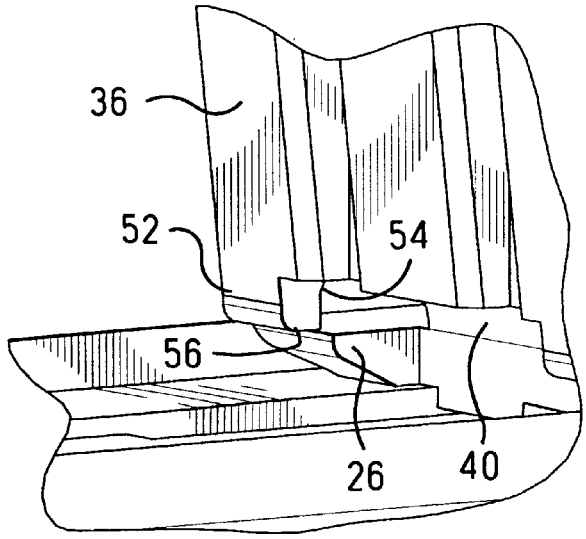
FIG. 8 is an enlarged perspective view of the interior of the connector with the cover in the open position and showing one interlocking projection on the cover and one on the upper housing wall.

Not only do the projections 26 and 52 provide an interlock for the living hinge 40, but the projections and living hinge can also be molded using simple straight pull tooling. The housing 10 and integral cover 36 are initially molded in the open configuration. As shown in FIG. 5, opposed mold tooling 80 and 82, shown in phantom, can be relatively pulled in a straight line away from the cover 36. Since the cover projections are located beside and not in overlapping relationship to the living hinge 40, the rear mold tooling 82 can mold the upper hinge surface 48 and the cover projection inclined surface 54 and ledge 56. The cover projections 52 are located above the wall outer surface 24 to provide access for the rear mold tooling 82. The front mold tooling 80 can then mold the front lower surface 50 of the living hinge 40.

The preferred embodiment of the electrical connector 2 shown herein is representative of the invention disclosed herein, but does not represent the only implementation of this invention. For example, an interlocking living hinge of this type is not limited to use with an electrical connector and is not limited to use in a terminal position assurance member or locking member in an electrical connector. The invention can also be used on electrical connectors other than the three position connector shown herein. For example, covers with interlocking living hinges can be used on opposite sides of connectors having two rows of terminals. The interlocking projections can also be employed in the center of a living hinge that flanks without overlapping the projections. Other features could also be employed on the cover member, such as an L-shaped cover that would enclose not only the top of the connector, but the front of the connector as well. Therefore, the invention disclosed herein is not limited to the preferred embodiment but to other embodiments and equivalents structures that would be apparent to one of ordinary skill in the art. The invention is defined by the following claims.

We claim:

1. An electrical connector including a living hinge joining a cover to a main housing, the living hinge being integrally molded to a housing wall and to the cover, rotation of the cover closing an opening in the housing wall, the cover and the housing wall each including interlocking projections located beside the living hinge, an interlocking projection on the cover rotating beneath an interlocking projection on the housing wall when the cover is rotated to close the opening with the interlocking projections preventing dislodgment of the cover from the housing wall adjacent to the living hinge in the event of damage to the living hinge, wherein the interlocking projections extend longitudinally relative to laterally facing edges of the living hinge, and wherein the cover interlocking projection includes an inclined inner surface extending beyond the intersection of an upper and lower surface o the living hinge with the cover, the cover interlocking projection including a ledge extending from the inclined inner surface.

2. The electrical connector of claim 1 wherein the cover interlocking projection extends from a cover top surface and the housing interlocking projection extends from the housing wall.

3. The electrical connector of claim 2 wherein the cover interlocking projection extends away from the opening and the housing interlocking projection extends toward the opening.

4. The electrical connector of claim 1 wherein cover interlocking projections and housing interlocking projections are located on both sides of the living hinge.

5. The electrical connector of claim 1 wherein the housing interlocking projection includes an inclined surface opposed to the inclined inner surface of the cover interlocking projection when the cover closes the opening.

6. The electrical connector of claim 5 wherein the housing includes a recess adjacent to the housing interlocking projection, the cover ledge extending into the housing recess when the cover closes the opening.

7. The electrical connector of claim 1 wherein the cover interlocking projection extends beyond an outer surface of the housing wall when the cover is in an open position so that the cover interlocking projection can be molded by a mold tooling extending parallel to the housing wall.

8. An electrical connector including at least one terminal and a molded housing having longitudinally extending cavities for each terminal, each terminal being secured within a corresponding cavity, a cover integrally molded to the housing and pivotal with respect to the housing between an open and a closed position, the cover including latching means engagable with the housing on a distal end of the cover and a living hinge on the opposite end of the cover, connecting the cover to the housing, the housing including a first longitudinally extending projection and the cover including a second longitudinally extending projection, each projection being adjacent to the living hinge, the first and second projections overlapping when the cover latch engages the housing with the cover in a closed position, the first and second overlapping projections preventing disengagement of the cover in the event of damage to the living hinge, wherein the first and second projections extend in opposite longitudinal directions, each of the first and second projections extending longitudinally over at least part of the longitudinal extent of the living hinge.

9. The electrical connector of claim 8 wherein the first and second projections are located adjacent at least one lateral edge of the living hinge.

10. The electrical connector of claim 9 wherein first and second projections are located along two lateral edges of the living hinge.

11. The electrical connector of claim 8 wherein the cover includes at least one longitudinally facing cover shoulder on an inner surface and the housing includes a longitudinally facing housing shoulder facing the living hinge, the longitudinally facing cover shoulder and housing shoulder being opposed when the cover is in the closed position to prevent longitudinal movement of the cover in the event of damage to the living hinge.

12. The electrical connector of claim 11 wherein the longitudinally facing shoulders are sufficiently proximate when the cover is closed to prevent the first and second projections from moving from an overlapping relationship.

13. The electrical connector of claim 11 wherein the cover latching means and the overlapping first and second projections prevent opposite ends from moving away from the housing and the opposed shoulders prevent disengagement of the first and second projections and of the cover latching means with the housing.

14. The electrical connector of claim 8 wherein the first projection extends from the same housing wall from which the living hinge extends.

15. The electrical connector of claim 8 wherein the housing includes a recess and the second projection on the cover includes a ledge extending into the recess when the cover is in the closed position.

16. An electrical connector including multiple terminals and a molded housing having cavities for the terminals, each terminal being secured within a corresponding cavity by a deflectable latch, the housing including a locking member engaging the deflectable latches to prevent disengagement of the latches from corresponding terminals, the locking member being joined to the housing by a living hinge, the locking member and the housing each having interlocking projections adjacent to the living hinge to prevent disengagement of the locking member from the housing in the event of damage to the living hinge.

17. The electrical connector of claim 16 wherein the locking member has a width greater than the living hinge, the interlocking projection on the locking member being adjacent to the living hinge.

18. The electrical connector of claim 16 wherein the locking member is pivoted about the living hinge relative to the housing.

19. The electrical connector of claim 18 wherein the living hinge joins the locking member to one exterior wall of the housing intermediate the ends of the housing with the locking member extending to a mating face of the housing when the locking member is in engagement with the deflectable latches.

20. The electrical connector of claim 19 wherein the interlocking projections on the housing extend longitudinally from the living hinge toward the mating face of the housing.

21. The electrical connector of claim 20 wherein the interlocking projection on the locking member is rotatable beneath the interlocking projection on the housing as the locking member is pivoted about the living hinge into engagement with the deflectable latches.

22. The electrical connector of claim 16 wherein the locking member comprises a terminal position assurance member.

23. The electrical connector of claim 16 wherein the locking member comprises a cover extending over mating sections of the terminals.

24. The electrical connector of claim 16 wherein the locking member and the housing include mutually opposed shoulders, the opposed shoulders and the interlocking projections preventing movement of the locking member in two perpendicular directions to prevent disengagement of the locking member in the event of damage to the living hinge.

25. The electrical connector of claim 16 wherein interlocking projections on the locking member and interlocking projections on the housing each have inclined surfaces to permit mutual relative rotation as the locking member is moved into engagement with the deflectable latches.

* * * * *